US009034430B2

(12) United States Patent
Zhou et al.

(10) Patent No.: US 9,034,430 B2
(45) Date of Patent: May 19, 2015

(54) MANUFACTURE METHOD OF METAL PLATE SUBSTRATE FOR COMPUTER-TO-PLATE OF INKJET PRINTING

(75) Inventors: Haihua Zhou, Beijing (CN); Yanlin Song, Beijing (CN)

(73) Assignee: Institute of Chemistry, Chinese Academy of Sciences, Beijing (CN)

( * ) Notice: Subject to any disclaimer, the term of this patent is extended or adjusted under 35 U.S.C. 154(b) by 516 days.

(21) Appl. No.: 13/124,658

(22) PCT Filed: Aug. 28, 2009

(86) PCT No.: PCT/CN2009/073586
§ 371 (c)(1),
(2), (4) Date: Apr. 15, 2011

(87) PCT Pub. No.: WO2010/043139
PCT Pub. Date: Apr. 22, 2010

(65) Prior Publication Data

US 2012/0021129 A1 Jan. 26, 2012

(30) Foreign Application Priority Data

| | | |
|---|---|---|
| Oct. 16, 2008 | (CN) | 2008 1 0224100 |
| Dec. 5, 2008 | (CN) | 2008 1 0239265 |
| Jul. 13, 2009 | (CN) | 2009 1 0088268 |

(51) Int. Cl.

| | |
|---|---|
| ***B05D 3/12*** | (2006.01) |
| ***B41N 3/03*** | (2006.01) |
| ***B05D 5/08*** | (2006.01) |
| ***B05D 3/10*** | (2006.01) |
| ***B05D 3/00*** | (2006.01) |
| ***B41N 3/04*** | (2006.01) |

(52) U.S. Cl.
CPC *B41N 3/036* (2013.01); *B05D 5/08* (2013.01); *B05D 3/102* (2013.01); *B05D 3/12* (2013.01); *B05D 3/002* (2013.01); *B41N 3/04* (2013.01)

(58) Field of Classification Search
USPC ..... 427/327
See application file for complete search history.

(56) References Cited

U.S. PATENT DOCUMENTS

| | | | | |
|---|---|---|---|---|
| 6,673,435 | B1 | 1/2004 | Tashiro et al. | |
| 6,740,464 | B2 * | 5/2004 | Maemoto | 430/138 |
| 6,912,956 | B2 * | 7/2005 | Mori | 101/459 |
| 7,571,542 | B2 * | 8/2009 | Nishino et al. | 29/895.3 |
| 2003/0013043 | A1 * | 1/2003 | Inno et al. | 430/302 |
| 2004/0048191 | A1 * | 3/2004 | Inno | 430/270.1 |
| 2004/0123761 | A1 | 7/2004 | Szumla et al. | |
| 2005/0130065 | A1 * | 6/2005 | Hiraoka | 430/300 |
| 2005/0159281 | A1 * | 7/2005 | Nishino et al. | 492/1 |
| 2006/0019196 | A1 * | 1/2006 | Miyoshi | 430/270.1 |
| 2008/0118859 | A1 * | 5/2008 | Ezure | 430/270.1 |

FOREIGN PATENT DOCUMENTS

| | | | |
|---|---|---|---|
| CN | 85100875 | A | 8/1986 |
| CN | 1403514 | A | 3/2003 |
| CN | 1476988 | A | 2/2004 |
| CN | 1640962 | A | 7/2005 |
| CN | 1789347 | A | 6/2006 |
| CN | 101195312 | A * | 6/2008 |
| CN | 101293441 | A | 10/2008 |
| CN | 101397438 | A | 4/2009 |
| CN | 101422992 | A | 5/2009 |
| EP | 1334842 | A | 8/2003 |
| JP | 2004358818 | A | 12/2004 |
| WO | WO 00/46039 | A | 8/2000 |

OTHER PUBLICATIONS

PCT International Search Report for PCT Counterpart Application No. PCT/CN2009/073586 containing Communication relating to the Results of the Partial International Search Report, 4 pgs., (Dec. 3, 2009).

* cited by examiner

*Primary Examiner* — David Turocy
(74) *Attorney, Agent, or Firm* — Blakely, Sokoloff, Taylor & Zafman LLP

(57) ABSTRACT

A method for preparing a metal substrate for inkjet CTP, comprising: treating a metal substrate by anodizing or non-anodizing (such as sandpaper burnishing, sand blasting, polishing, or brushing), and then applying a hydrophilic polymer paint on the surface of the metal substrate. Due to the existence of nano-size or micron-size oxide particles in the hydrophilic polymer paint, the metal substrate has high specific surface energy, while the metal substrate has a certain roughness, therefore the metal substrate has ink absorbency and good abrasive resistance. The metal substrate can reduce the spread of ink droplets and produces print image having better resolution and definition. The non-anodizing method can avoid environmental pollution which is caused by waste acid and waste alkali discharge of anodizing method.

8 Claims, 2 Drawing Sheets

MANUFACTURE METHOD OF METAL PLATE SUBSTRATE FOR COMPUTER-TO-PLATE OF INKJET PRINTING

CROSS-REFERENCE TO RELATED APPLICATIONS

This patent application is a U.S. National Phase application under 35 U.S.C. §371 of International Application No. PCT/CN2009/073586, filed on Aug. 28, 2009, entitled MANUFACTURE METHOD OF METAL PLATE SUBSTRATE FOR COMPUTER-TO-PLATE OF INK-JET PRINTING, which claims priority to Chinese Patent Application No. 200810224100.7, filed on Oct. 16, 2008, Chinese Patent Applicat on No. 200810239265.1, filed on Dec. 5, 2008, and Chinese Patent Application No. 200910088268.4 filed on Jul. 13, 2009.

FIELD OF THE INVENTION

The present invention pertains to the printing plate field, and relates to a method for preparing metal substrate for Inkjet Computer-To-Plate (CTP), in particular to a method including applying hydrophilic polymer paint on a metal substrate that is treated or not treated by anodization.

BACKGROUND OF THE INVENTION

Inkjet CTP technique is a technique that utilizes an inkjet printing apparatus to spray images directly on a metal substrate or a polymer substrate. The metal substrate for plate making may be a zinc plate, copper plate, or aluminum plate. To improve the durability and resolution of the metal substrate, usually the metal substrate is roughened (see CN85100875) to a certain degree of roughness on its surface. At present, the roughening methods may be categorized into methods that utilize anodization and methods that don't utilize anodization. The anodization process is matured and widely applied. Usually, the roughness parameter Ra of the metal substrate surface after anodization treatment is Ra=0.6~0.9 μm (Ra is a height parameter, i.e., the arithmetic mean deviation of profile). However, to avoid severe environmental pollution that may be caused by a large quantity of acid or alkali waste liquid and increased overall manufacturing cost of the finished plate, a method that doesn't utilize anodization may be used to treat the metal substrate.

The main object of the present invention is to prepare a metal substrate that has appropriate roughness as well as high absorbency and wearability and can be used for Inkjet CTP, by roughening the metal substrate by anodization or through a method that doesn't utilizes anodization and then applying hydrophilic polymer paint on the surface of the metal substrate, or directly applying hydrophilic polymer paint on the surface of the metal substrate. In the present invention, the raw material of the metal substrate paint is cheap, and the method for preparing the metal substrate is simple.

SUMMARY OF THE INVENTION

The first object of the present invention is to provide a method for preparing a metal substrate for Inkjet CTP.

The second object of the present invention is to provide a method of preparing a metal substrate for Inkjet CTP, by roughening the metal substrate by anodization or through a method that doesn't utilize anodization and then applying hydrophilic polymer paint on the surface of the metal substrate.

The third object of the present invention is to provide a hydrophilic polymer paint for a metal substrate for Inkjet CTP.

The fourth object of the present invention is to provide a method for preparing a hydrophilic polymer paint for a metal substrate for Inkjet CTP.

The present invention comprises a process of treating a metal substrate with the conventional anodization method or a method that doesn't utilizes anodization, such as sandpaper burnishing, sand blasting, polishing, or brushing.

The method for preparing a metal substrate for Inkjet CTP provided in the present invention comprises:

treating a metal substrate for inkjet CTP by anodization, applying uniformly a hydrophilic polymer paint that contains hydrophilic polymer and nano-size or micron-size oxide particles on the surface of the anodized metal substrate, and drying, to obtain the metal substrate for inkjet CTP; or treating a non-anodized metal substrate for inkjet CTP directly by sandpaper burnishing, sand blasting, polishing, or brushing, applying uniformly a hydrophilic polymer paint that contains a hydrophilic polymer and nano-size or micron-size oxide particles on the surface of the metal substrate treated by sandpaper burnishing, sand blasting, polishing, or brushing, and then drying, to obtain the metal substrate for inkjet CTP; or directly applying (e.g., by spin coating) uniformly a hydrophilic polymer paint that contains a hydrophilic polymer and nano-size or micron-size oxide particles on a non-anodized metal substrate for inkjet CTP, and then drying, to obtain the metal substrate for Inkjet CTP.

The coating amount of the hydrophilic polymer paint on the metal substrate for Inkjet CTP may be 1~2.5 g/m$^2$.

The contact angle between the metal substrate coated uniformly with hydrophilic polymer paint on its surface and the quick-dry plate-making ink may be within a range of 2~75 degree, preferably 20~40 degree.

The present invention utilizes the bonding property of the hydrophilic polymer to bond the nano-size or micron-size oxide particles onto the surface of the metal substrate, so as to attain appropriate roughness to facilitate ink absorption; therefore, a satisfactory metal substrate can be obtained even if the non-anodized metal substrate is not treated by sandpaper burnishing, sand blasting, polishing, or brushing, etc. However, the bonding strength between the coated film and the metal substrate may be significantly increased by treating the metal substrate by sandpaer burnishing, sand blasting, polishing, or brushing and thereby durability may be improved; therefore, preferably the non-anodized metal substrate for Inkjet CTP is directly treated by sandpaper burnishing, sand blasting, polishing, or brushing, before the hydrophilic polymer paint is applied.

The hydrophilic polymer paint may be applied uniformly by spin coating on the surface of a metal substrate that has a certain degree of roughness obtained by treating with the conventional anodization technique (usually the surface roughness parameter Ra of metal substrate treated by anodization is Ra=0.6~0.9 μm) or the surface of a non-anodized metal substrate that has a certain degree of roughness obtained by sandpaper burnishing, sand blasting, polishing, or brushing, cleaning with acetone and water and drying; wherein the drying temperature may be 100~200° C., and the drying duration may be 0.5~12 h.

The sandpaper burnishing treatment is to uniformly burnish the surface of the metal substrate in transverse and longitudinal directions with a sand paper having particle size within 20~200 μm (under 0.5~2.5 KPa burnishing pressure).

The sand blasting treatment is to blast quartz sand or alumina particles with particle size within 10~220 nm onto the surface of the metal substrate by using a dry sand blaster or liquid sand blaster, wherein the blasting speed and blasting amount may be adjusted according to the preset Ra value.

The polishing treatment is to burnish the surface of the metal substrate with a polishing wheel uniformly in transverse and longitudinal directions, wherein an emulsion of chrome oxide powder with particle size within 10~100 μm is used as the polishing medium between the polishing wheel and the surface of the metal substrate; the rotation speed of the polishing wheel may be 20~30 m/s.

The emulsion of chrome oxide powder contains chrome oxide powder at 2~25 mass % concentration (based on the total mass of chrome oxide powder and emulsion).

The emulsion is prepared from oil (e.g., mineral oil) and surfactant; wherein, the content of oil may be 5~25 wt % (based on the total weight of the emulsion). The oil is at least one selected from animal oil (e.g., at least one of lard fat, beef fat, chicken fat, and sheep fat), vegetable oil (e.g., at least one of sunflower seed oil, rape seed oil, peanut oil, maize oil, soybean oil, pine oil, palm oil, castor oil, and olive oil), fatty acid, fatty acid soap, and fatty alcohol; the surfactant is at least one selected from sodium petroleum sulfonate, sodium oleate soap, polyoxyethylene fatty alcohol ether, and alkenyl succinic acid.

The brushing treatment is to wet brush the surface of the metal substrate uniformly with a nylon brush in transverse and longitudinal directions, wherein an abrasive material prepared from water and alumina sand with particle size within 20~50 μm, powdered pumice with particle size within 20~50 μm, or aluminum silicate sand with particle size within 20~50 μm is used as the medium between the nylon brush and the surface of the metal substrate, and the nylon brush is produced from nylon wires having a diameter of 0.2~0.5 mm and a length of 30~60 mm.

The roughness parameter Ra of the surface of metal substrate treated by sandpaper burnishing, sand blasting, polishing, or brushing is Ra=0.6~3 μm, wherein, the parameter Ra is a height parameter, i.e., the arithmetic mean deviation of profile. The Ra value is calculated according to the following formula with reference to FIG. 6, and shall be Ra=0.6~3 μm.

$$Ra = \frac{1}{n}\sum_{i=1}^{n}|y_i|$$

Hydrophilic polymer paint is applied uniformly on the surface of an anodized or non-anodized metal substrate, and the nano-size or micron-size oxide particles is bonded onto the surface of the metal substrate due to the bonding property of the hydrophilic high molecular polymer in the paint, so as to attain appropriate roughness and facilitate ink absorption.

The ingredients and content of the hydrophilic polymer paint used for the metal substrate for Inkjet CTP are (based on the total weight of the paint):

| | |
|---|---|
| Hydrophilic high molecular polymer | 0.95~15 wt % |
| Nano-size or micron-size oxide particles | 0.05~15 wt % |
| An additive | 0~1 wt % |
| Solvent | Remaining |

The hydrophilic polymer paint is prepared by mixing the hydrophilic high molecular polymer, nano-size or micron-size oxide particles, the additive, and solvent and dispersing by ball milling or ultrasonic dispersion at room temperature; wherein, the paint contains 0.95~15 wt % hydrophilic high molecular polymer, 0.05~15 wt % nano-size or micron-size oxide particles, 0~1 wt % additive, and solvent (remaining content).

The hydrophilic high molecular polymer may be at least one selected from polyvinyl alcohol, polyvinyl acetal, gelatin, polyacrylamide resin, and polyvinylpyrrolidone; or at least one selected from water-soluble phenolic resin, polyacrylic resin, polyacrylic resin ester, polymethacrylic resin, polymethacrylic resin ester, polyethylene glycol, polyethylene glycol acetal, cellulose polymer, copolymer of acrylic acid and acrylate, copolymer of methacrylic acid and methacrylic ester, copolymer of acrylic acid and methacrylic ester, and copolymer of methacrylic acid and acrylate.

The nano-size or micron-size oxide particles has particle size within 10~3,000 μm, and may be one of silica, alumina, and titania, preferably silica.

The solvent may be water or mixture of water and lower alcohol, wherein, the concentration of lower alcohol in the mixture is 1~10 wt %; or, the solvent may be at least one selected from acetone, butanone, ethylene glycol monoether, ethylene glycol methyl ether, propylene glycol methyl ether, diethyl ether, and tetrahydrofuran. The lower alcohol may be one of methanol, absolute ethyl alcohol, 1-propyl alcohol, 2-propyl alcohol, 2-butyl alcohol, and 2-methyl-2-propyl alcohol.

The additive may be at least one of cationic fixing agent, anti-foaming agent, and antioxidant.

If a water-based ink is used for printing, cationic fixing agent may be added in the paint. The cationic fixing agent may be at least one of polyethylene imine, polyvinyl amine, and poly dimethyl diallyl ammonium chloride.

The anti-foaming agent may be organo-siloxane or polyether.

The antioxidant may be polyhydric alcohol ester.

The metal substrate may be a zinc plate, copper plate, or aluminum plate, preferably aluminum plate.

The ingredients and preparation method of the quick-dry plate-making ink may be various ones; for example, as indicated in Patent Application No. CN200510132249.9, the quick-dry plate-making ink contains 1~10 wt % nanometer pigment particles, 1~15 wt % lipophilic resin, 10~40 wt % quick-dry solvent, 1~8 wt % humectant, and 50~85 wt % main solvent.

With the preparation method described in Patent Application No. CN200510132249.9, the ingredients and contents of the quick-dry plate making ink can be further adjusted, so that the quick-dry plate making ink contains 0.01~5 wt % nanometer pigment particles, 4~45 wt % lipophilic resin, 10~40 wt % quick-dry solvent, 0.1~5 wt % humectant, and 40~85 wt % main solvent.

The nanometer pigment particles in the quick-dry plate-making ink may have particle size of 20~200 nm, preferably 50~100 nm. The nanometer pigment particles may be prepared by ball milling dispersion or ultrasonic dispersion (see the method described in CN200410000322.2, titled as Nano-size Inorganic Pigment Color Paste for Ink Used for Inkjet Printing). The hue of the nanometer pigment is not limited, and may be any of blue nanometer pigments, black nanometer pigments, red nanometer pigments, yellow nanometer pigments, and green nanometer pigments.

Specifically, in blue nanometer pigments, organic pigments such as phthalocyanine blue or inorganic pigments such as ultramarine blue, cobalt blue, or brilliant blue are preferred; in black nanometer pigments, soot carbon is preferred; in red nanometer pigments, organic pigments such as organic red or inorganic pigments such as iron oxide red are preferred; in yellow nanometer pigments, organic pigments such as organic yellow or inorganic pigments such as iron oxide yellow or titanium yellow are preferred; in green nanometer pigments, organic pigments such as phthalocyanine green are preferred.

More preferably, C. I. phthalocyanine blue 15:4, an organic phthalocyanine blue, is used; more preferably, C. I. soot carbon 6 is used; more preferably, C. I. pigment red 122 is used; more preferably, C. I. pigment yellow 138, an organic yellow, is used; more preferably, C. I. phthalocyanine green G, an organic phthalocyanine green, is used.

The nanometer pigment added in the quick-dry plate making ink may be any nanometer pigment, not limited to the nanometer pigments specified above, as long as the nanometer pigment meets the requirement for particle size and can be dispersed homogeneously in the system.

The lipophilic resin in the quick-dry plate making ink may be one of phenolic resin, polyester resin, lipophilic silicone resin, epoxy resin, urea formaldehyde resin, and glycerol phthalic resin.

The quick-dry solvent in the quick-dry plate making ink may be one of absolute ethyl alcohol, diethyl ether, and ethylene glycol.

The humectant in the quick-dry plate making ink may be glycerol, propylene glycol, or sorbitol.

The main solvent in the quick-dry plate making ink may be ethylene glycol monoethyl ether, ethylene glycol monoethyl ether, ethylene glycol mono-n-dutyl ether, propylene glycol monomethyl ether, propylene glycol monoethyl ether, or propylene glycol monomethyl ether acetate.

The method for preparing a metal substrate for Inkjet CTP disclosed in the present invention comprises: treating a metal substrate with the conventional anodization method or a method that doesn't utilizes anodization, such as sandpaper burnishing, sand blasting, polishing, or brushing, and then applying hydrophilic polymer paint on the surface of the treated metal substrate. Owing to the existence of nano-size or micron-size oxide particles in the hydrophilic polymer paint, the metal substrate has high specific surface energy and appropriate roughness, as well as high absorbency and wearability. The introduction of the non-anodization method can avoid environmental pollution caused by acid or alkali waste discharged in the anodization process. The metal substrate obtained with the method provided in the present invention can be used as the metal substrate for Inkjet CTP, and can be printed directly with an Inkjet CTP machine; therefore, the post-treatment procedures are eliminated; in addition, the metal substrate can reduce diffusion of ink droplets, and therefore the printed image has higher resolution and sharpness.

DETAILED DESCRIPTION OF THE EMBODIMENTS

Example 1

Preparation of hydrophilic polymer paint: weigh 0.975 g gelatin and 0.025 g silica (with particle size of 2~3 μm), load them into a 100 ml triangular flask, add 49 g distilled water, disperse by ball milling dispersion or ultrasonic dispersion for 6~10 h, to obtain the hydrophilic polymer paint.

Burnish uniformly the surface of an aluminum substrate under 0.5 Kpa pressure with a sand paper having particle size of 20 μm (manufacturer: Beijing Dongxin Abrasive Tools Co., Ltd.) to the surface roughness Ra shown in Table 1.

Figure 1:
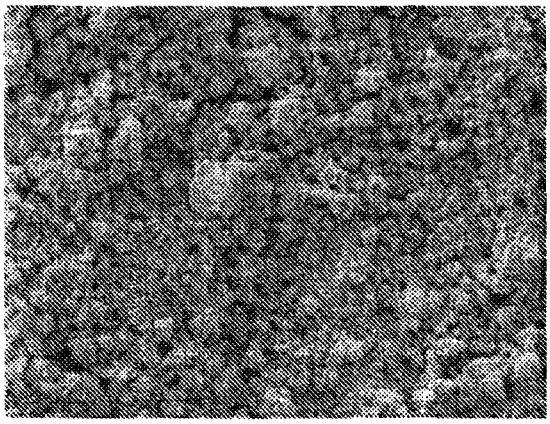
FIG. 1 is a SEM photograph at 1,500× magnification of the surface of an aluminum substrate treated by burnishing and coated with paint in example 1 of the present invention.
Figure 2:
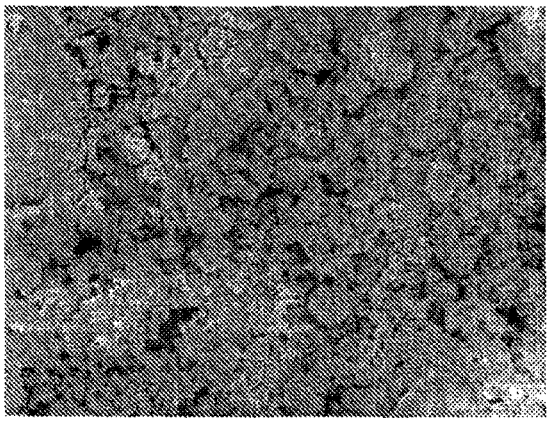
FIG. 2 is a SEM photograph at 8,000× magnification of the surface of the aluminum substrate treated by burnishing and coated with paint in example 1 of the present invention.

Cut the burnished aluminum substrate into 10×10 $cm^2$ pieces, wash the pieces with acetone and distilled water successively, and then dry the pieces at 100~200° C. for 0.5~12 h. Apply the hydrophilic polymer paint uniformly on the burnished aluminum substrate by spin coating with a spin-coater, and control the coating amount of the hydrophilic polymer paint at 1 $g/m^2$ by controlling the speed of the spin-coater. Dry the aluminum substrate for about 1 h at 200° C., and measure the contact angle between the surface of the aluminum substrate that is burnished and coated with hydrophilic polymer paint and the quick-dry plate making ink, and the cohesive force between the hydrophilic polymer paint and the surface of the aluminum substrate, as shown in Table 1 and Table 4. SEM photographs of the surface of the aluminum substrate that is burnished and coated is shown in FIG. 1 (magnification: 1,500×, scale: 10 μm/cm) and FIG. 2 (magnification: 8,000×, scale: 2 μm/cm).

The quick-dry plate making ink comprises 0.01 g nanometer pigment (soot carbon 6) with 20~200 μm particle size, 4.09 g polyester resin, 10 g absolute ethyl alcohol, 0.9 g glycerol, and 85 g ethylene glycol monoethyl ether.

Example 2

Preparation of hydrophilic polymer paint: weigh 0.5 g polyvinyl alcohol (degree of polymerization: 2,500, degree of alcoholysis: 88%), 0.5 g polyvinylpyrrolidone, 3.75 g silica (particle size: 10~20 μm), load them into a 50 ml triangular flask, add 15.25 g distilled water and 5 g absolute ethyl alcohol, and disperse by ball milling dispersion or ultrasonic dispersion for 6~8 h, to obtain the hydrophilic polymer paint.

Burnish uniformly the surface of an aluminum substrate under 2.5 Kpa pressure with a piece of sand paper having particle size of 200 μm (manufacturer: Beijing Dongxin Abrasive Tools Co., Ltd.) to the surface roughness Ra shown in Table 1.

Cut the burnished aluminum substrate into 10×10 $cm^2$ pieces, wash the pieces with acetone and distilled water successively, and the dry the pieces. Apply the hydrophilic polymer paint uniformly on the burnished aluminum substrate by spin coating with a spin-coater, and control the coating amount of the hydrophilic polymer paint at 2.5 $g/m^2$ by controlling the speed of the spin-coater. Dry the aluminum substrate for about 0.5 h at 200° C., and measure the contact angle between the surface of the aluminum substrate that is burnished and coated with hydrophilic polymer paint and the quick-dry plate making ink and the cohesive force between the hydrophilic polymer paint and the surface of the aluminum substrate, as shown in Table 1 and Table 4.

The quick-dry plate making ink comprises 5 g C. I. pigment yellow 138 having particle size of 20~200 μm, 45 g polyester resin, 10 g absolute ethyl alcohol, 1 g propylene glycol, and 39 g ethylene glycol monoethyl ether.

Example 3

Preparation of hydrophilic polymer paint: weigh 2.5 g gelatin, 1.25 g polyacrylamide, and 1.25 g silica (having particle size of 2~3 μm), load them into a 50 ml triangular flask, add 18 g distilled water and 2 g methanol, disperse by ball milling dispersion or ultrasonic dispersion for 6~10 h, to obtain the hydrophilic polymer paint.

Burnish uniformly the surface of a zinc substrate under 2.5 Kpa pressure with a piece of sand paper having particle size of 100 μm (manufacturer: Beijing Dongxin Abrasive Tools Co., Ltd.) to the surface roughness Ra shown in Table 1.

Cut the burnished zinc substrate into 10×10 $cm^2$ pieces, wash the pieces with acetone and distilled water successively, and the dry the pieces. Apply the hydrophilic polymer paint uniformly on the burnished zinc substrate by spin coating with a spin-coater, and control the coating amount of the hydrophilic polymer paint to 1 $g/m^2$ by controlling the speed of the spin-coater. Dry the zinc substrate for about 2 h at 110° C., and measure the contact angle between the surface of the zinc substrate that is burnished and coated with hydrophilic polymer paint and the quick-dry plate making ink and the cohesive force between the hydrophilic polymer paint and the surface of the zinc substrate, as shown in Table 1 and Table 4.

The quick-dry plate making ink comprises 0.1 g C. I. phthalocyanine blue 15:4 in organic phthalocyanine blue having particle size of 20~200 μm, 4 g phenolic resin, 10 g absolute ethyl alcohol, 0.9 g glycerol, and 85 g ethylene glycol monoethyl ether.

Example 4

Preparation of hydrophilic polymer paint: weigh 2.5 g polyethylene glycol, 5 g cellulose acetate, and 0.25 g silica (having particle size of 2~3 μm), and 0.25 g polyethylene imine, load them into a 100 ml triangular flask, add 42 g acetone, disperse by ball milling dispersion or ultrasonic dispersion for 2~5 h, to obtain the hydrophilic polymer paint.

Take refined quartz sand having particle size of 10 μm as the abrasive material, immerse the abrasive material in water, and carry out liquid blasting with a liquid blaster on the zinc substrate to the surface roughness Ra shown in Table 1.

Figure 3:
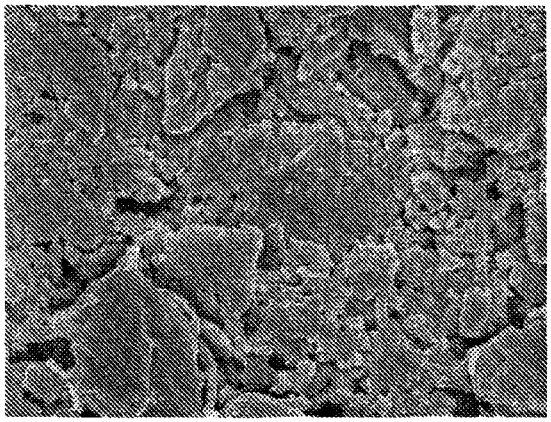
FIG. 3 is a SEM photograph at 20,000× magnification of the surface of a zinc substrate treated by sand blasting and coated with paint in example 4 of the present invention.

Cut the zinc substrate treated by sand blasting into 10×10 $cm^2$ pieces, wash the pieces with acetone and distilled water successively, and then dry the pieces (at 100~200° C. drying temperature for 0.5~12 h). Apply the hydrophilic polymer paint uniformly on the treated zinc substrate by spin coating with a spin-coater, and control the coating amount of the hydrophilic polymer paint to 1 $g/m^2$ by controlling the speed of the spin-coater. Dry the zinc substrate for about 3 h at 120° C., and measure the contact angle between the surface of the zinc substrate that is treated by sand blasting and coated with hydrophilic polymer paint and the quick-dry plate making ink and the cohesive force between the hydrophilic polymer paint and the surface of the zinc substrate, as shown in Table 1 and Table 4. A SEM photograph of the surface of the zinc substrate treated by sand blasting and coated with the paint is shown in FIG. 3 (magnification: 20,000×, scale: 0.5 μm/cm).

The quick-dry plate making ink comprises 0.01 g C. I. phthalocyanine blue 15:4 having particle size of 20~200 μm, 45 g phenolic resin, 10 g absolute ethyl alcohol, 0.99 g glycerol, and 44 g ethylene glycol monoethyl ether.

Example 5

Preparation of hydrophilic polymer paint: weigh 0.475 g polyvinyl butyral (degree of acetalization<50%), 0.275 g silica (having particle size of 2~3 μm), and 0.25 g polyhydric alcohol ester, load them into a 100 ml triangular flask, add 49 g butanone, disperse by ball milling dispersion or ultrasonic dispersion for 1~3 h, to obtain the hydrophilic polymer paint.

Take alumina having particle size of 120 μm as the abrasive material, immerse the abrasive material in water, and carry out liquid blasting with a liquid blaster on an aluminum substrate to the surface roughness Ra shown in Table 1.

Cut the aluminum substrate treated by sand blasting into 10×10 $cm^2$ pieces, wash the pieces with acetone and distilled water successively, and the dry the pieces. Apply the hydrophilic polymer paint uniformly on the treated aluminum substrate by spin coating with a spin-coater, and control the coating amount of the hydrophilic polymer paint to 1 $g/m^2$ by controlling the speed of the spin-coater. Dry the aluminum substrate for about 12 h at 100° C., and measure the contact angle between the surface of the aluminum substrate that is treated by sand blasting and coated with hydrophilic polymer paint and the quick-dry plate making ink and the cohesive force between the hydrophilic polymer paint and the surface of the aluminum substrate, as shown in Table 1 and Table 4.

The quick-dry plate making ink comprises 0.2 g C. I. phthalocyanine blue 15:4 having particle size of 20~200 μm, 19.7 g polyester resin, 40 g absolute ethyl alcohol, 0.1 g glycerol, and 40 g ethylene glycol monoethyl ether.

Example 6

Preparation of hydrophilic polymer paint: weigh 5.225 g phenolic resin (sulfonated) and 0.025 g alumina (having particle size of 10~20 μm), load them into a 100 ml triangular flask, add 40 g ethylene glycol monomethyl ether and 4.75 g 1-propyl alcohol, disperse by ball milling dispersion or ultrasonic dispersion for 2~4 h, to obtain the hydrophilic polymer paint.

Take alumina having particle size of 220 μm as the abrasive material, immerse the abrasive material in water, and carry out liquid blasting with a liquid blaster on the aluminum substrate to the surface roughness Ra shown in Table 1.

Cut the aluminum substrate treated by sand blasting into 10×10 $cm^2$ pieces, wash the pieces with acetone and distilled water successively, and the dry the pieces. Apply the hydrophilic polymer paint uniformly on the treated aluminum substrate by spin coating with a spin-coater, and control the coating amount of the hydrophilic polymer paint to 1.5 $g/m^2$ by controlling the speed of the spin-coater. Dry the aluminum substrate for 8~9 h at 120~150° C., and measure the contact angle between the surface of the aluminum substrate that is treated by sand blasting and coated with hydrophilic polymer paint and the quick-dry plate making ink and the cohesive force between the hydrophilic polymer paint and the surface of the aluminum substrate, as shown in Table 1 and Table 4.

The quick-dry plate making ink comprises 0.06 g C. I. phthalocyanine blue 15:4 having particle size of 20~200 μm, 4 g polyester resin, 10 g absolute ethyl alcohol, 0.94 g glycerol, and 85 g ethylene glycol monoethyl ether.

Example 7

Preparation of hydrophilic polymer paint: weigh 5.225 g copolymer of acrylic acid and butyl acrylate, 2.5 g polymethacrylic resin, 0.025 g silica (having particle size of 2~3 μm), and 0.5 g organo-siloxane, load them into a 100 ml triangular flask, add 41.75 g water, and disperse by ball milling dispersion or ultrasonic dispersion for 2~5 h, to obtain the hydrophilic polymer paint.

Burnish the surface of a copper substrate uniformly in transverse and longitudinal directions by using a polishing wheel that works at 20~30 m/s speed, with 25 wt % emulsion of chrome oxide powder having particle size of 10 μm as the polishing medium between the polishing wheel and the surface of the copper substrate, wherein, the emulsion is prepared from 5 wt % soybean oil and polyoxyethylene fatty alcohol ether. The surface roughness Ra of the copper substrate after polishing is shown in Table 1.

Cut the copper substrate treated by polishing into 10×10 $cm^2$ pieces, wash the pieces with acetone and distilled water successively, and then dry the pieces at 100~200° C. for 0.5~12 h. Apply the hydrophilic polymer paint uniformly on the treated copper substrate by spin coating with a spin-coater, and control the coating amount of the hydrophilic polymer paint to 1 $g/m^2$ by controlling the speed of the spin-coater. Dry the copper substrate for 11~12 h at 100° C., and measure the contact angle between the surface of the copper substrate that is treated by polishing and coated with hydrophilic polymer paint and the quick-dry plate making ink and the cohesive force between the hydrophilic polymer paint and the surface of the copper substrate, as shown in Table 1 and Table 4.

The quick-dry plate making ink comprises 5 g nanometer pigment (soot carbon 6) having particle size of 20~200 μm, 40 g polyester resin, 14 g absolute ethyl alcohol, 1 g glycerol, and 40 g ethylene glycol monoethyl ether.

Example 8

Preparation of hydrophilic polymer paint: weigh 5 g polyacrylic resin, 2.5 g copolymer of methacrylic acid and ethyl methacrylate, and 7.5 g silica (having particle size of 2~3 μm), load them into a 100 ml triangular flask, add 35 g water, and disperse by ball milling dispersion or ultrasonic dispersion for 2~5 h, to obtain the hydrophilic polymer paint.

Burnish the surface of an aluminum substrate uniformly in transverse and longitudinal directions by using a polishing wheel that works at 20~30 m/s speed, with 2 wt % emulsion of chrome oxide powder having particle size of 50 μm as the polishing medium between the polishing wheel and the surface of the aluminum substrate, wherein, the emulsion is prepared from 25 wt % lard fat and sodium oleate soap. The surface roughness Ra of the aluminum substrate after polishing is shown in Table 2. Cut the aluminum substrate treated by polishing into 10×10 $cm^2$ pieces, wash the pieces with acetone and distilled water successively, and the dry the pieces. Apply the hydrophilic polymer paint uniformly on the treated aluminum substrate by spin coating with a spin-coater, and control the coating amount of the hydrophilic polymer paint to 1.5 $g/m^2$ by controlling the speed of the spin-coater. Dry the aluminum substrate for 0.5 h at 200° C., and measure the contact angle between the surface of the aluminum substrate that is treated by polishing and coated with hydrophilic polymer paint and the quick-dry plate making ink and the cohesive force between the hydrophilic polymer paint and the surface of the aluminum substrate, as shown in Table 2 and Table 4.

The quick-dry plate making ink comprises 3 g nanometer pigment (soot carbon 6) having particle size of 20~200 μm, 10 g lipophilic silicone resin, 10 g absolute ethyl alcohol, 2 g glycerol, and 75 g ethylene glycol monoethyl ether.

Example 9

Preparation of hydrophilic polymer paint: weigh 1.25 g polyvinyl alcohol (degree of polymerization: 1,700, degree of alcoholysis: 99%) and 3.75 g silica (having particle size of 2~3 μm), load them into a 50 ml triangular flask, add 20 g distilled water, disperse by ball milling dispersion or ultrasonic dispersion for 6~8 h, to obtain the hydrophilic polymer paint.

Burnish the surface of an aluminum substrate uniformly in transverse and longitudinal directions with a polishing wheel that works at 20~30 m/s speed, with 10 wt % emulsion of chrome oxide powder having particle size of 100 μm as the polishing medium between the polishing wheel and the surface of the aluminum substrate, wherein, the emulsion is prepared from 15 wt % sunflower seed oil and petroleum sulfonate. The surface roughness Ra of the aluminum substrate after polishing is shown in Table 2.

Cut the aluminum substrate treated by polishing into 10×10 $cm^2$ pieces, wash the pieces with acetone and distilled water successively, and the dry the pieces. Apply the hydrophilic polymer paint uniformly on the treated aluminum substrate by spin coating with a spin-coater, and control the coating amount of the hydrophilic polymer paint to 2.5 $g/m^2$ by controlling the speed of the spin-coater. Dry the aluminum substrate for about 3 h at 100° C., and measure the contact angle between the surface of the aluminum substrate that is treated by polishing and coated with hydrophilic polymer paint and the quick-dry plate making ink and the cohesive force between the hydrophilic polymer paint and the surface of the aluminum substrate, as shown in Table 2 and Table 4.

The quick-dry plate making ink comprises 0.2 g nanometer pigment (soot carbon 6) having particle size of 20~200 μm, 18 g lipophilic silicone resin, 40 g absolute ethyl alcohol, 1.8 g glycerol, and 40 g ethylene glycol monoethyl ether.

Example 10

Preparation of hydrophilic polymer paint: weigh 0.975 g gelatin and 0.025 g silica (having particle size of 2~3 μm), load them into a 100 ml triangular flask, add 49 g distilled water, disperse by ball milling dispersion or ultrasonic dispersion for 6~10 h, to obtain the hydrophilic polymer paint.

Brush the surface of an aluminum substrate uniformly in transverse and longitudinal directions by using a nylon brush made of nylon wires in 0.2 mm diameter and 60 mm length, with water and alumina abrasive having particle size of 20 μm as the brushing medium between the nylon brush and the aluminum substrate, to the surface roughness Ra shown in Table 2.

Figure 4:
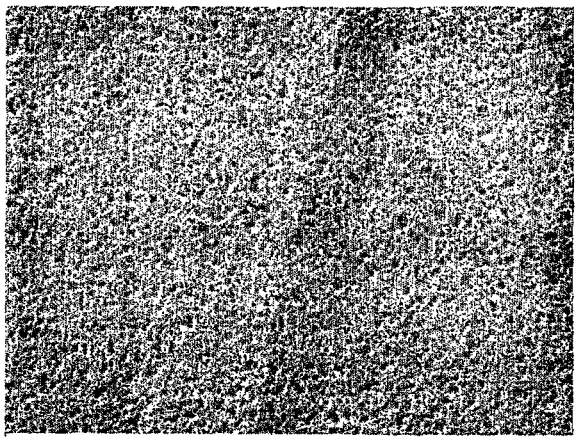
FIG. 4 is a SEM photograph at 150× magnification of inkjet printing lines in example 10 of the present invention.

Cut the aluminum substrate treated by brushing into 10×10 $cm^2$ pieces, wash the pieces with acetone and distilled water successively, and then dry the pieces at 100~200° C. for 0.5~12 h. Apply the hydrophilic polymer paint uniformly on the brushed aluminum substrate by spin coating with a spin-coater, and control the coating amount of the hydrophilic polymer paint to 1 $g/m^2$ by controlling the speed of the spin-coater. Dry the aluminum substrate for about 1 h at 200° C., and measure the contact angle between the surface of the aluminum substrate that is brushed and coated with hydrophilic polymer paint and the quick-dry plate making ink and the cohesive force between the hydrophilic polymer paint and the surface of the aluminum substrate, as shown in Table 2 and Table 4. Print on the aluminum substrate that is treated by brushing and coated with hydrophilic polymer paint with quick-dry plate making ink. A SEM photograph of the inkjet printing lines is shown in FIG. 4 (magnification: 150×, scale: 100 μm/cm).

The quick-dry plate making ink comprises 0.01 g nanometer pigment (soot carbon 6) having particle size of 20~200 μm, 45 g lipophilic silicone resin, 10 g absolute ethyl alcohol, 5 g glycerol, and 39.99 g ethylene glycol monoethyl ether.

Example 11

Preparation of hydrophilic polymer paint: weigh 0.5 g polyvinyl alcohol (degree of polymerization: 2,500, degree of alcoholysis: 88%), 0.5 g polyvinylpyrrolidone, 3.75 g silica (particle size: 10~20 μm), load them into a 50 ml triangular flask, add 15.25 g distilled water and 5 g absolute ethyl alcohol, and disperse by ball milling dispersion or ultrasonic dispersion for 6~8 h, to obtain the hydrophilic polymer paint.

Brush the surface of an aluminum substrate uniformly in transverse and longitudinal directions by using a nylon brush made of nylon wires in 0.5 mm diameter and 30 mm length, with water and alumina abrasive having particle size of 50 μm as the brushing medium between the nylon brush and the aluminum substrate, to the surface roughness Ra shown in Table 2.

Figure 5:
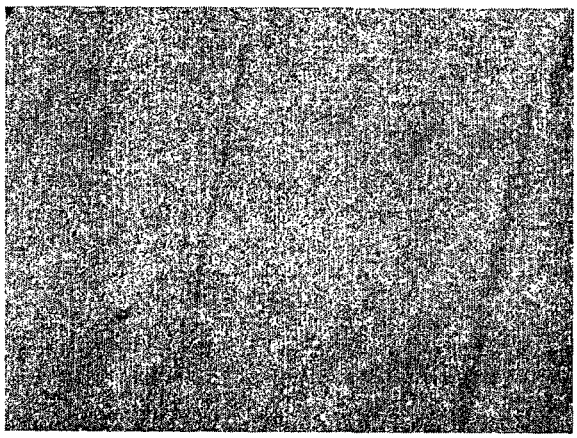
FIG. 5 is a SEM photograph at 35× magnification of inkjet printing lines in example 11 of the present invention.
Figure 6:
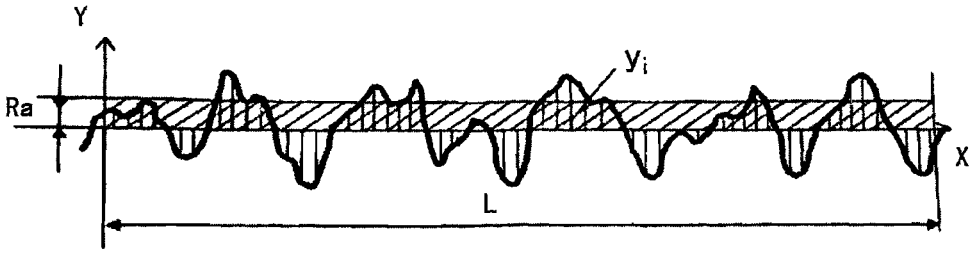
FIG. 6 is a schematic diagram of surface roughness Ra (height parameter, the arithmetic mean deviation of profile), wherein, Ra=the arithmetic mean deviation of profile, n=numbers of profiles, $y_i$=mean peak half-width of profile, L=sample length.

Cut the aluminum substrate treated by brushing into 10×10 $cm^2$ pieces, wash the pieces with acetone and distilled water successively, and the dry the pieces. Apply the hydrophilic polymer paint uniformly on the brushed aluminum substrate by spin coating with a spin-coater, and control the coating amount of the hydrophilic polymer paint to 2.5 $g/m^2$ by controlling the speed of the spin-coater. Dry the aluminum substrate for about 0.5 h at 200° C., and measure the contact angle between the surface of the aluminum substrate that is brushed and coated with hydrophilic polymer paint and the quick-dry plate making ink and the cohesive force between the hydrophilic polymer paint and the surface of the aluminum substrate, as shown in Table 2 and Table 4. Print on the aluminum substrate that is treated by brushing and coated with hydrophilic polymer paint with quick-dry plate making ink. A SEM photograph of the inkjet printing lines is shown in FIG. 5 (magnification: 35×, scale: 200 μm/cm).

The quick-dry plate making ink comprises 5 g nanometer pigment (soot carbon 6) having particle size of 20~200 nm, 40 g phenolic resin, 10 g absolute ethyl alcohol, 5 g glycerol, and 40 g ethylene glycol monoethyl ether.

Example 12

Preparation of hydrophilic polymer paint: weigh 0.5 g polyvinyl alcohol (degree of polymerization: 2,500, degree of alcoholysis: 88%), 0.5 g polyvinylpyrrolidone, 3.75 g silica (particle size: 10~20 μm), load them into a 50 ml triangular flask, add 15.25 g distilled water and 5 g absolute ethyl alcohol, and disperse by ball milling dispersion or ultrasonic dispersion for 6~8 h, to obtain the hydrophilic polymer paint.

Brush the surface of an aluminum substrate uniformly in transverse and longitudinal directions by using a nylon brush made of nylon wires in 0.3 mm diameter and 45 mm length, with water and alumina abrasive having particle size of 40 μm as the brushing medium between the nylon brush and the aluminum substrate, to the surface roughness Ra shown in Table 2.

Cut the aluminum substrate treated by brushing into 10×10 $cm^2$ pieces, wash the pieces with acetone and distilled water successively, and the dry the pieces. Apply the hydrophilic polymer paint uniformly on the brushed aluminum substrate by spin coating with a spin-coater, and control the coating amount of the hydrophilic polymer paint to 2.5 $g/m^2$ by controlling the speed of the spin-coater. Dry the aluminum substrate for about 0.5 h at 200° C., and measure the contact angle between the surface of the aluminum substrate that is treated by brushing and coated with hydrophilic polymer paint and the quick-dry plate making ink and the cohesive force between the hydrophilic polymer paint and the surface of the aluminum substrate, as shown in Table 2 and Table 4.

The quick-dry plate making ink comprises 2 g C.I. phthalocyanine green G having particle size of 20~200 μm, 10 g phenolic resin, 20 g polyester resin, 10 g absolute ethyl alcohol, 0.1 g glycerol, and 57.9 g ethylene glycol monoethyl ether.

Example 13

Preparation of hydrophilic polymer paint: weigh 0.975 g gelatin and 0.025 g titania (having particle size of 2~3 μm), load them into a 100 ml triangular flask, add 49 g distilled water, disperse by ball milling dispersion or ultrasonic dispersion for 6~10 h, to obtain the hydrophilic polymer paint.

Take an anodized aluminum substrate obtained through the existing technique, with surface roughness Ra shown in Table 2.

Cut the aluminum substrate treated by anodization into 10×10 $cm^2$ pieces, wash the pieces with acetone and distilled water successively, and then dry them at 100~200° C. for 0.5~12 h). Apply the hydrophilic polymer paint uniformly on the anodized aluminum substrate by spin coating with a spin-coater, and control the coating amount of the hydrophilic polymer paint to 1 $g/m^2$ by controlling the speed of the spin-coater. Dry the aluminum substrate for about 1 h at 200° C., and measure the contact angle between the surface of the aluminum substrate that is treated by anodization and coated with hydrophilic polymer paint and the quick-dry plate making ink and the cohesive force between the hydrophilic polymer paint and the surface of the aluminum substrate, as shown in Table 2 and Table 4.

The quick-dry plate making ink comprises 0.01 g nanometer pigment (soot carbon 6) having particle size of 20~200 μm, 10.09 g phenolic resin, 40 g lipophilic silicone resin, 10 g absolute ethyl alcohol, 0.1 g glycerol, 19.8 g ethylene glycol monoethyl ether, and 20 g ethylene glycol monoethyl ether.

Example 14

Preparation of hydrophilic polymer paint: weigh 1 g polyvinyl alcohol (degree of polymerization: 2,500, degree of alcoholysis: 88%) and 0.25 g titania (having particle size of 10~20 nm), load them into a 50 ml triangular flask, add 18.75 g distilled water and 5 g absolute ethyl alcohol, disperse by ball milling dispersion or ultrasonic dispersion for 6~8 h, to obtain the hydrophilic polymer paint.

Take an anodized aluminum substrate obtained through the existing technique, with surface roughness Ra shown in Table 2.

Cut the aluminum substrate treated by anodization into 10×10 $cm^2$ pieces, wash the pieces with acetone and distilled water successively, and the dry the pieces. Apply the hydrophilic polymer paint uniformly on the anodized aluminum substrate by spin coating with a spin-coater, and control the coating amount of the hydrophilic polymer paint to 2.5 g/m$^2$ by controlling the speed of the spin-coater. Dry the aluminum substrate for about 0.5 h at 200° C., and measure the contact angle between the surface of the aluminum substrate that is treated by anodization and coated with hydrophilic polymer paint and the quick-dry plate making ink and the cohesive force between the hydrophilic polymer paint and the surface of the aluminum substrate, as shown in Table 2 and Table 4.

The quick-dry plate making ink comprises 0.01 g nanometer pigment (soot carbon 6) having particle size of 20~200 μm, 5 g polyester resin, 40 g lipophilic silicone resin, 10 g absolute ethyl alcohol, 0.1 g glycerol, 0.8 g propylene glycol, and 44 g ethylene glycol monoethyl ether.

Example 15

Preparation of hydrophilic polymer paint: weigh 1.25 g polyvinyl alcohol (degree of polymerization: 1,700, degree of alcoholysis: 99%) and 3.75 g silica (having particle size of 2~3 μm), load them into a 50 ml triangular flask, add 20 g distilled water, and disperse by ball milling dispersion or ultrasonic dispersion for 6~8 h, to obtain the hydrophilic polymer paint.

Take an aluminum substrate that is not treated by anodization, sandpaper burnishing, sand blasting, polishing, or brushing, etc., cut the aluminum substrate treated by anodization into 10×10 cm$^2$ pieces, wash the pieces with acetone and distilled water successively, and the dry the pieces. Apply the hydrophilic polymer paint uniformly on the aluminum substrate by spin coating with a spin-coater, and control the coating amount of the hydrophilic polymer paint to 1 g/m$^2$ by controlling the speed of the spin-coater. Dry the aluminum substrate for about 3 h at 100° C., and measure the surface roughness parameter Ra of the aluminum substrate and the contact angle and adhesion between the surface of the aluminum substrate and the quick-dry plate making ink, as shown in Table 3 and Table 5.

The quick-dry plate making ink comprises 0.01 g C. I. pigment red 122 having particle size of 20~200 nm, 4 g epoxy resin, 10 g absolute ethyl alcohol, 0.99 g glycerol, and 85 g ethylene glycol monoethyl ether.

Example 16

Preparation of hydrophilic polymer paint: weigh 1 g polyvinyl alcohol (degree of polymerization: 2,500, degree of alcoholysis: 88%), 0.5 g polyvinylpyrrolidone, and 0.25 g silica (having particle size of 10~20 nm), load them into a 50 ml triangular flask, add 18.25 g distilled water and 5 g absolute ethyl alcohol, disperse by ball milling dispersion or ultrasonic dispersion for 6~8 h, to obtain the hydrophilic polymer paint. Take an aluminum substrate that is not treated by anodization, sandpaper burnishing, sand blasting, polishing, or brushing, etc., cut the aluminum substrate treated by anodization into 10×10 cm$^2$ pieces, wash the pieces with acetone and distilled water successively, and the dry the pieces. Apply the hydrophilic polymer paint uniformly on the aluminum substrate by spin coating with a spin-coater, and control the coating amount of the hydrophilic polymer paint to 2.5 g/m$^2$ by controlling the speed of the spin-coater. Dry the aluminum substrate for about 0.5 h at 200° C., and measure the surface roughness parameter Ra of the aluminum substrate and the contact angle and adhesion between the surface of the aluminum substrate and the quick-dry plate making ink, as shown in Table 3 and Table 5.

The quick-dry plate making ink comprises 5 g C. I. phthalocyanine blue 15:4 having particle size of 20~200 μm, 40 g epoxy resin, 10 g absolute ethyl alcohol, 5 g glycerol, and 40 g propylene glycol monoethyl ether.

Example 17

Preparation of hydrophilic polymer paint: weigh 2.5 g gelatin, 1.25 g polyacrylamide, and 1.25 g silica (having particle size of 2~3 μm), load them into a 50 ml triangular flask, add 20 g distilled water, and disperse by ball milling dispersion or ultrasonic dispersion for 6~10 h, to obtain the hydrophilic polymer paint.

Take an aluminum substrate that is not treated by anodization, sandpaper burnishing, sand blasting, polishing, or brushing, etc., cut the aluminum substrate treated by anodization into 10×10 cm$^2$ pieces, wash the pieces with acetone and distilled water successively, and the dry the pieces. Apply the hydrophilic polymer paint uniformly on the aluminum substrate by spin coating with a spin-coater, and control the coating amount of the hydrophilic polymer paint to 2 g/m$^2$ by controlling the speed of the spin-coater. Dry the aluminum substrate for about 3 h at 110° C., and measure the surface roughness parameter Ra of the aluminum substrate and the contact angle and adhesion between the surface of the aluminum substrate and the quick-dry plate making ink, as shown in Table 3 and Table 5.

The quick-dry plate making ink comprises 2 g inorganic iron oxide red having particle size of 20~200 μm, 30 g urea formaldehyde resin, 40 g absolute ethyl alcohol, 3 g glycerol, and 25 g ethylene glycol mono-n-dutyl ether.

Example 18

Preparation of hydrophilic polymer paint: weigh 7.5 g polyvinyl butyral (degree of acetalization <50%), 0.25 g silica (having particle size of 2~3 μm), and 0.25 g polyhydric alcohol ester, load them into a 100 ml triangular flask, add 42 g acetone, and disperse by ball milling dispersion or ultrasonic dispersion for 1~3 h, to obtain the hydrophilic polymer paint.

Take an aluminum substrate that is not treated by anodization, sandpaper burnishing, sand blasting, polishing, or brushing, etc., cut the aluminum substrate treated by anodization into 10×10 cm$^2$ pieces, wash the pieces with acetone and distilled water successively, and the dry the pieces. Apply the hydrophilic polymer paint uniformly on the aluminum substrate by spin coating with a spin-coater, and control the coating amount of the hydrophilic polymer paint to 1.5 g/m$^2$ by controlling the speed of the spin-coater. Dry the aluminum substrate for about 3 h at 100° C., and measure the surface roughness parameter Ra of the aluminum substrate and the contact angle and adhesion between the surface of the aluminum substrate and the quick-dry plate making ink, as shown in Table 3 and Table 5.

The quick-dry plate making ink comprises 0.03 g organic phthalocyanine green having particle size of 20~200 nm, 45 g lipophilic silicone resin, 10 g absolute ethyl alcohol, 0.27 g glycerol, and 44.7 g ethylene glycol mono-n-dutyl ether.

Example 19

Preparation of hydrophilic polymer paint: weight 5 g phenolic resin and 0.25 g alumina having particle size of 10~20 μm, load them into a 100 ml triangular flask, add 44.75 g ethylene glycol monomethyl ether, and disperse by ball milling dispersion or ultrasonic dispersion for 2~4 h, to obtain the hydrophilic polymer paint.

Take an aluminum substrate that is not treated by anodization, sandpaper burnishing, sand blasting, polishing, or brushing, etc., cut the aluminum substrate treated by anodization into 10×10 $cm^2$ pieces, wash the pieces with acetone and distilled water successively, and the dry the pieces. Apply the hydrophilic polymer paint uniformly on the aluminum substrate by spin coating with a spin-coater, and control the coating amount of the hydrophilic polymer paint to 2 $g/m^2$ by controlling the speed of the spin-coater. Dry the aluminum substrate for 8~9 h at 120~150° C., and measure the surface roughness parameter Ra of the aluminum substrate and the contact angle and adhesion between the surface of the aluminum substrate and the quick-dry plate making ink, as shown in Table 3 and Table 5.

The quick-dry plate making ink comprises 1 g C. I. pigment soot carbon 6 having particle size of 20~200 μm, 20 g phenolic resin, 10 g absolute ethyl alcohol, 0.2 g glycerol, and 68.8 g ethylene glycol monoethyl ether.

Example 20

Preparation of hydrophilic polymer paint: weigh 2.5 g polyethylene glycol, 5 g hydroxypropyl cellulose, 0.25 g silica having particle size of 2~3 μme, and 0.25 g polyethylene imine, load them into a 100 ml triangular flask, add 42 g distilled water, and disperse by ball milling dispersion or ultrasonic dispersion for 2~5 h, to obtain the hydrophilic polymer paint.

Take an aluminum substrate that is not treated by anodization, sandpaper burnishing, sand blasting, polishing, or brushing, etc., cut the aluminum substrate treated by anodization into 10×10 $cm^2$ pieces, wash the pieces with acetone and distilled water successively, and the dry the pieces. Apply the hydrophilic polymer paint uniformly on the aluminum substrate by spin coating with a spin-coater, and control the coating amount of the hydrophilic polymer paint to 1.2 $g/m^2$ by controlling the speed of the spin-coater. Dry the aluminum substrate for about 3 h at 120° C., and measure the surface roughness parameter Ra of the aluminum substrate and the contact angle and adhesion between the surface of the aluminum substrate and the quick-dry plate making ink, as shown in Table 3 and Table 5.

The quick-dry plate making ink comprises 0.05 g C. I. pigment yellow 138 having particle size of 20~200 μm, 10 g polyester resin, 20 g absolute ethyl alcohol, 0.25 g glycerol, and 69.7 g propylene glycol monomethyl ether.

Example 21

Preparation of hydrophilic polymer paint: weigh 5 g copolymer of acrylic acid and butyl acrylate, 2.5 g polymethacrylic resin, 0.25 g silica having particle size of 2~3 μm, and 0.5 g organo-siloxane, load them into a 100 ml triangular flask, add 41.75 g water, and disperse by ball milling dispersion or ultrasonic dispersion for 2~5 h, to obtain the hydrophilic polymer paint.

Take an aluminum substrate that is not treated by anodization, sandpaper burnishing, sand blasting, polishing, or brushing, etc., cut the aluminum substrate treated by anodization into 10×10 $cm^2$ pieces, wash the pieces with acetone and distilled water successively, and the dry the pieces. Apply the hydrophilic polymer paint uniformly on the aluminum substrate by spin coating with a spin-coater, and control the coating amount of the hydrophilic polymer paint to 1 $g/m^2$ by controlling the speed of the spin-coater. Dry the aluminum substrate for 11~12 h at 100° C., and measure the surface roughness parameter Ra of the aluminum substrate and the contact angle and adhesion between the surface of the aluminum substrate and the quick-dry plate making ink, as shown in Table 3 and Table 5.

The quick-dry plate making ink comprises 2.5 g inorganic iron oxide red having particle size of 20~200 μm, 30 g phenolic resin, 10 g absolute ethyl alcohol, 0.5 g glycerol, and 57 g ethylene glycol mono-n-dutyl ether.

Example 22

Preparation of hydrophilic polymer paint: weigh 5 g polyacrylic resin, 2.5 g copolymer of methacrylic acid and ethyl methacrylate, and 0.25 g silica having particle size of 2~3 μm, load them into a 100 ml triangular flask, add 42.25 g water, and disperse by ball milling dispersion or ultrasonic dispersion for 2~5 h, to obtain the hydrophilic polymer paint.

Take an aluminum substrate that is not treated by anodization, sandpaper burnishing, sand blasting, polishing, or brushing, etc., cut the aluminum substrate treated by anodization into 10×10 $cm^2$ pieces, wash the pieces with acetone and distilled water successively, and the dry the pieces. Apply the hydrophilic polymer paint uniformly on the aluminum substrate by spin coating with a spin-coater, and control the coating amount of the hydrophilic polymer paint to 2 $g/m^2$ by controlling the speed of the spin-coater. Dry the aluminum substrate for about 0.5 h at 200° C., and measure the surface roughness parameter Ra of the aluminum substrate and the contact angle and adhesion between the surface of the aluminum substrate and the quick-dry plate making ink, as shown in Table 3 and Table 5.

The quick-dry plate making ink comprises 3 g inorganic iron oxide red having particle size of 20~200 μm, 40 g glycerol phthalic resin, 20 g absolute ethyl alcohol, 2 g glycerol, and 35 g propylene glycol monomethyl ether acetate.

The contact angle and surface roughness Ra of each of the metal substrates treated differently and coated with a hydrophilic polymer paint in examples 1~22 are measured. If the contact angle between the metal substrate and the quick-dry plate making ink is 20~40 degree, the ink droplets have clear edge and small diffusion area, and the resolution and sharpness of the printed image can be improved; if the contact angle between the metal substrate and the quick-dry plate making is 0~20 degree or 40~60 degree, the ink droplets diffuse slightly on the edge and the dots are slightly enlarged. In addition, the measurement result of cohesive force indicates the durability of the paint on the substrate. The micro-structure formed by the nanometer particles on the substrate improves the absorbency of the substrate.

TABLE 1

Measurement Result of Contact Angle between Metal Surface Coated with Hydrophilic Polymer Paint and Quick-Dry Plate Making Ink, and Ra of Metal Surface

| | Example | | | | | | |
|---|---|---|---|---|---|---|---|
| | 1 | 2 | 3 | 4 | 5 | 6 | 7 |
| Surface contact angle (unit: degree) | 37.1 | 30.2 | 33.9 | 2.0 | 52.5 | 25.3 | 20.0 |
| Surface roughness (Ra, unit: μm) | 3.00 | 1.40 | 1.09 | 0.66 | 0.62 | 0.60 | 3.00 |

TABLE 2

Measurement Result of Contact Angle between Metal Surface Coated with Hydrophilic Polymer Paint and Quick-Dry Plate Making Ink and Ra of Metal Surface

| | Example | | | | | | |
|---|---|---|---|---|---|---|---|
| | 8 | 9 | 10 | 11 | 12 | 13 | 14 |
| Surface contact angle (unit: degree) | 42.5 | 40.0 | 64.6 | 35.2 | 74.0 | 50.3 | 40.1 |
| Surface roughness (Ra, unit: μm) | 1.40 | 1.09 | 0.66 | 0.62 | 1.02 | 0.65 | 0.72 |

TABLE 3

Measurement Result of Contact Angle between Metal Surface Coated with Hydrophilic Polymer Paint and Quick-Dry Plate Making Ink and Ra of Metal Surface

| | Example | | | | | | | |
|---|---|---|---|---|---|---|---|---|
| | 15 | 16 | 17 | 18 | 19 | 20 | 21 | 22 |
| Surface contact angle (unit: degree) | 35.8 | 32.3 | 36.9 | 45.1 | 40.0 | 25.3 | 20.0 | 29.5 |
| Surface roughness (Ra, unit: μm) | 2.50 | 1.69 | 1.85 | 2.69 | 1.40 | 2.80 | 3.00 | 2.75 |

Note:
The coated film of hydrophilic polymer paint has little influence on the surface roughness Ra of the metal substrate.

The cohesive strength values between the film obtained by coating the hydrophilic polymer paint and aluminum substrate, zinc substrate, and copper substrate are measured with a paint film scriber (manufacturer: Tianjin Dongwenya Material Testing Machine Co., Ltd.). The higher the cohesive strength is, the higher the durability will be. Levels 0~5 indicate cohesive force from strong to weak. The result is shown in Table 4 and Table 5.

TABLE 4

Measurement Result of Cohesive Force between Hydrophilic Polymer Paint Film and Metal Substrate

| | Example | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Level | 0 | 0 | 0 | 2 | 2 | 0 | 0 | 1 | 0 | 1 | 0 | 1 | 2 | 0 |

TABLE 5

Measurement Result of Cohesive Force between Hydrophilic Polymer Paint Film and Metal Substrate

| | Example | | | | | | | |
|---|---|---|---|---|---|---|---|---|
| | 15 | 16 | 17 | 18 | 19 | 20 | 21 | 22 |
| Level | 4 | 5 | 4 | 5 | 2 | 3 | 2 | 2 |

What is claimed is:

1. A method for preparing a metal substrate for inkjet Computer-To-Plate (CTP), the method selected from the group consisting of an anodization method, a non-anodizing method, and a direct method;

(1) the anodization method consisting of:

(a) treating the metal substrate by anodization;

(b) applying uniformly a hydrophilic polymer paint on a surface of the anodized metal substrate; and (c) drying the surface;

(2) the non-anodizing method consisting of:

(a) treating the metal substrate directly by sandpaper burnishing, sand blasting, polishing, or brushing;

(b) applying uniformly the hydrophilic polymer paint on the surface of the treated metal substrate; and (c) drying the surface; and (3) the direct method consisting of directly applying uniformly the hydrophilic polymer paint on the metal substrate;

wherein the hydrophilic polymer paint used in the anodization method, the non-anodizing method, and the direct method consists of a hydrophilic polymer having a concentration from 0.95 weight % to 15 weight %;

nano-size or micron-size oxide particles having a concentration from 0.05 weight % to 15 weight %;

at least one additive having a concentration from 0% weight % to weight %; and at least one solvent remaining;

wherein the hydrophilic polymer is (a) at least one selected from polyvinyl alcohol, polyvinyl acetal, gelatin, polyacrylamide resin, and polyvinylpyrrolidone; or (b) at least one selected from water-soluble phenolic resin, polyacrylic resin, polyacrylic resin ester, polymethacrylic resin, polymethacrylic resin ester, polyethylene glycol, polyethylene glycol acetal, cellulose polymer, copolymer of acrylic acid and acrylate, copolymer of methacrylic acid and methacrylic ester, copolymer of acrylic acid and methacrylic ester, and copolymer of methacrylic acid and acrylate;

wherein each of the nano-size or micron-size oxide particles (a) has a particle size from 10 nanometers to 3,000 nanometers and (b) is one selected from one of silica, alumina, or titania;

wherein the coating amount of the hydrophilic polymer paint on the metal substrate from 1 $g/m^2$ to 2.5 $g/m^2$ and wherein the at least one additive is at least one of a cationic fixing agent, an anti-foaming agent, or an antioxidant.

2. The method according to claim 1, wherein a contact angle between the metal substrate coated uniformly with hydrophilic polymer paint on its surface and the quick-dry plate-making ink is within a range of 2 degrees to 75 degrees.

3. The method according to claim 1, wherein the contact angle between the metal substrate coated uniformly with hydrophilic polymer paint on its surface and the quick-dry plate-making ink is within a range of 20 degrees to 40 degrees.

4. The method according to claim 1, wherein the at least one solvent is selected from water or a mixture of water and lower alcohol, wherein the concentration of the lower alcohol in the mixture is from 1 weight % to 10 weight % or the solvent is at least one selected from acetone, butanone, ethylene glycol monoether, ethylene glycol methyl ether, propylene glycol methyl ether, diethyl ether, and tetrahydrofuran; wherein the lower alcohol is one of methanol, absolute ethyl alcohol, 1-propyl alcohol, 2-propyl alcohol, 2-butyl alcohol, or 2-methyl-2-propyl alcohol.

5. The method according to claim 4, wherein the cationic fixing agent is at least one selected from polyethylene imine, polyvinyl amine, and poly dimethyl diallyl ammonium chloride;

the anti-foaming agent is organo-siloxane or polyether; and the antioxidant is polyhydric alcohol ester.

6. The method according to claim 1, wherein a surface roughness parameter Ra of the metal substrate treated by sandpaper burnishing, sand blasting, polishing, or brushing is from 0.6 μm to 3 μm, wherein Ra is a height parameter, the arithmetic mean deviation of profile.

7. The method according to claim 1, wherein the sandpaper burnishing comprises burnishing the surface of the metal substrate uniformly in transverse and longitudinal directions with a sand paper having a particle size of 20 μm to 200 μm;

the sand blasting comprises blasting quartz sand or alumina particles with particle size within 10 μm to 220 μm to the surface of the metal substrate by using a dry sand blaster or liquid sand blaster;

the polishing comprises burnishing the surface of the metal substrate with a polishing wheel uniformly in transverse and longitudinal directions, wherein an emulsion of chrome oxide powder with particle size within 10 μm to 100 μm is used as the polishing medium between the polishing wheel and the surface of the metal substrate;

the brushing comprises wet brushing the surface of the metal substrate uniformly with a nylon brush in transverse and longitudinal directions, wherein an abrasive material prepared from water and alumina sand with particle size within 20 μm to 50 μm, powdered pumice with particle size within 20 μm to 50 μm, or aluminum silicate sand with particle size within 20 μm to 50 μm is used as the medium between the nylon brush and the surface of the metal substrate, and the nylon brush is produced from nylon wires having a diameter of 0.2 mm to 0.5 mm and a length of 30 mm to 60 mm.

8. The method according to claim 7, wherein the rotation speed of the polishing wheel is 20 m/s to 30 m/s; the emulsion of chrome oxide powder contains 2 to 25 mass % of chrome oxide powders, and the emulsion is prepared from an oil component and surfactant in which the content of the oil component is 5 to 25 mass %;

the oil component is at least one selected from animal oil, vegetable oil, fatty acid, fatty acid soap, and fatty alcohol; the surfactant is at least one selected from sodium petroleum sulfonate, sodium oleate soap, polyoxyethylene fatty alcohol ether, and alkenyl succinic acid.

* * * * *